US009360199B2

(12) United States Patent
Westermann

(10) Patent No.: US 9,360,199 B2
(45) Date of Patent: Jun. 7, 2016

(54) ELECTRIC ACTUATOR SYSTEM

(75) Inventor: Karsten Westermann, Sønderborg (DM)

(73) Assignee: Linak A/S, Nordborg (DK)

( * ) Notice: Subject to any disclaimer, the term of this patent is extended or adjusted under 35 U.S.C. 154(b) by 183 days.

(21) Appl. No.: 14/006,028

(22) PCT Filed: Apr. 12, 2012

(86) PCT No.: PCT/DK2012/000039

§ 371 (c)(1),
(2), (4) Date: Sep. 18, 2013

(87) PCT Pub. No.: WO2012/139577

PCT Pub. Date: Oct. 18, 2012

(65) Prior Publication Data

US 2014/0009917 A1 Jan. 9, 2014

(30) Foreign Application Priority Data

Apr. 12, 2011 (DK) ..... 2011 00287

(51) Int. Cl.

| | |
|---|---|
| ***A47B 7/02*** | (2006.01) |
| ***F21V 23/04*** | (2006.01) |
| ***A61G 7/018*** | (2006.01) |
| ***A61G 7/002*** | (2006.01) |
| *A61G 7/012* | (2006.01) |
| *A61G 7/015* | (2006.01) |
| *A61G 7/05* | (2006.01) |

(52) U.S. Cl.

CPC ..... *F21V 23/0442* (2013.01); *A61G 7/002* (2013.01); *A61G 7/018* (2013.01); *A61G 7/012* (2013.01); *A61G 7/015* (2013.01); *A61G 7/0506* (2013.01); *A61G 2203/32* (2013.01); *A61G 2203/36* (2013.01); *A61G 2203/44* (2013.01)

(58) Field of Classification Search

CPC ..... A61G 7/005; A61G 7/012; A61G 7/018; A61G 7/015; A47C 20/041; A47C 20/08; A47C 21/00; A47C 21/04; A47C 21/003; A47C 27/081

See application file for complete search history.

(56) References Cited

U.S. PATENT DOCUMENTS

| | | | | |
|---|---|---|---|---|
| 2,185,051 | A | 12/1939 | Daigle | |
| 4,934,468 | A | 6/1990 | Koerber et al. | |
| 5,276,432 | A | 1/1994 | Travis et al. | |
| 6,234,642 | B1 * | 5/2001 | Bokamper | A47C 21/003 362/130 |
| 7,066,041 | B2 | 6/2006 | Nielsen | |
| 7,874,695 | B2 | 1/2011 | Jensen | |
| 8,127,620 | B2 | 3/2012 | Morita et al. | |

(Continued)

FOREIGN PATENT DOCUMENTS

| | | | | |
|---|---|---|---|---|
| DK | EP 1955612 A2 * | 8/2008 | ..... | A61G 7/018 |
| DK | WO 2009021513 A1 * | 2/2009 | ..... | A47C 20/041 |

(Continued)

OTHER PUBLICATIONS

English Abstract of EP 1275896.

*Primary Examiner* — David E Sosnowski
(74) *Attorney, Agent, or Firm* — Dykema Gossett PLLC

(57) ABSTRACT

An electric actuator system for hospital and care beds (1, 20) for adjusting e.g. the lying surface of the bed (1, 20). The actuator system is connected to one or more light sources (19, 23, 24), which may be switched on if a change in the patient's movement pattern and/or position in the bed (1, 20) is registered. The electric actuator system may thus help the patient navigate around the room.

7 Claims, 3 Drawing Sheets

(56) References Cited

U.S. PATENT DOCUMENTS

| | | | | |
|---|---|---|---|---|
| 8,272,087 | B2 | 9/2012 | Westermann | |
| 8,381,336 | B2 | 2/2013 | Kazuno et al. | |
| 8,555,431 | B2 | 10/2013 | Nielsen | |
| 2007/0143920 | A1* | 6/2007 | Frondorf | A61G 7/005 5/81.1 R |
| 2007/0163045 | A1 | 7/2007 | Becker et al. | |
| 2007/0296600 | A1 | 12/2007 | Dixon et al. | |
| 2010/0005590 | A1* | 1/2010 | Jensen | A47C 20/041 5/611 |
| 2010/0139427 | A1* | 6/2010 | Yamaguchi | F16H 1/225 74/89.33 |
| 2011/0247139 | A1* | 10/2011 | Tallent | A61G 7/018 5/613 |
| 2014/0259418 | A1* | 9/2014 | Nunn | A47C 21/003 5/617 |

FOREIGN PATENT DOCUMENTS

| | | | | |
|---|---|---|---|---|
| EP | 1275896 | | 1/2003 | |
| EP | 2260755 | A1 * | 12/2010 | A61B 5/1115 |

* cited by examiner

ELECTRIC ACTUATOR SYSTEM

BACKGROUND OF THE INVENTION

1. Field of the Invention

The invention relates to an electric actuator system for hospital and care beds.

2. the Prior Art

The actuator system is according to the invention of the type which can be used for adjusting a hospital or care bed. In this type of bed the mattress is carried by a support surface having an adjustable backrest and legrest section, said support surface being mounted in a bed frame which may be raised and lowered by means of linear actuators in the actuator system. Further, the backrest and legrest sections of the bed may be adjusted by means of linear actuators. Normally, a type of linear actuator comprising a thrust rod, e.g. of the type described in WO 02/29284 A1 Linak A/S is used. This type of linear actuator (see also FIGS. 5 and 6) comprises a spindle with a spindle nut. The spindle is driven by a reversible electric motor through a transmission. When the spindle is driven, the spindle nut is moved in an inwards or outwards direction depending on the direction of rotation of the electric motor. The linear actuator is a separate product with the spindle, transmission and electric motor enclosed in a housing. The housing typically consists of a motor housing and an outer tube. An inner tube is secured to the spindle nut. The inner tube is displaced in and out of the outer tube as the spindle nut is moved in and out on the spindle. In the opposite end of the spindle nut the inner tube comprises a front mounting. The outer side of the motor housing is furnished with a rear mounting. The front mounting and rear mounting are used to secure the linear actuator in the structure which should be adjusted.

For certain patients in the hospital and care sector it is necessary for the nursing staff to know whether the patient is in the process of leaving his bed or has left his bed. Such a bed is i.a. described in U.S. Pat. No. 4,934,468 Hill Rom Co. Inc. and U.S. Pat. No. 5,276,432 Stryker Corp. These hospital beds are equipped with a weighing system for weighing and/or monitoring the patient's weight. The weighing system can however also be configured to monitor the patient's position in the bed. The weighing system can further be connected to an alarm which can give off a signal in case the patient assumes a position where it is conceivable that the patient may leave the bed or has already left the bed. A bed having similar characteristics is described in EP 1 974 708 A1 Paramount. Here, changes in the patient's center of gravity are registered by a number of interconnected weight sensors, located at each corner of the lying surface of the bed. By comparing the readings from each weight sensor, it can be detected whether a patient is sitting up and is thus potentially in the process of leaving the hospital bed, but naturally also whether the patient has left the bed.

Common for these types of bed structures is that they are intended for continuous weighing for accurate supervision of the patient's weight. In order to be able to do this with a sufficient accuracy, high-end sensors with a high resolution are used. This fact is thus also reflected in the price of these bed structures, which are very expensive. The use of these beds is thus also limited to a select few patients requiring special treatment and special care.

For care of patients, e.g., during the night, it has proven expedient to provide one or more orientation lights under the bed (Under Bed Light). The orientation light is both used by the users to navigate around the room when getting out of bed in the dark and by the staff to navigate around the room without having to turn on the ceiling light and thus disturbing the other bedbound patients. As an example, U.S. Pat. No. 6,234,642 B1 Dewert can be mentioned, where the orientation light of the bed is connected to the control box. Here, a sensor in the mattress of the bed can be connected to the control box such that the light in the control box is turned on when the patient sits up or has left the bed. The principle of having light under the bed where the activation thereof is linked to the user of the bed is known as far back as, e.g., U.S. Pat. No. 2,185,051 O. J. Daigle. This document discloses a bed which in connection with the lying surface comprises one or more switches which, if desired, can be connected in such a manner that a light source placed under the bed is turned on when the person, e.g., leaves the bed.

Activation of the orientation light under the bed by means of sensors in the mattress is however undesired as they often, and especially after continuous use, can give off faulty signals or signals may fail to appear. Although the signal for activation of the light could be provided by the beds comprising weight sensors described above, this would however represent a relatively expensive solution.

In addition to the orientation light located under the bed, it is known from EP 1 275 896 A1 Deapillat to integrate a light strip in the floor running from each bed in a shared bed room to a common bathroom. If a patient sits up in the bed or leaves the bed in the night, this is registered by a motion sensor located next to the bed. The motion sensor, which may, e.g., be an infrared sensor, gives off a signal to turn on both the light under the bed, in the light strip in the floor as well as in the bathroom. This ensures that the patient can find his way to the bathroom without disturbing the other patients in the bed room. The use of motion sensors is however undesired since the movement of other people in the room could cause unintended activation of the light. Furthermore, the integration of a light source in the floor is subject to a number of expenses. Further, the application of the room is limited as it is bound by the location of the light strip in the floor.

It is thus desired to provide an actuator system for a hospital or care bed which represents a simpler, more reliable and cheaper alternative for activating the orientation light, both in connection with the bed as well as in the proximity of the bed.

SUMMARY OF THE INVENTION

The actuator system according to the invention is characterized by being connected to one or more light sources which can be activated if one or more changes in the force on the actuator(s) are registered. Thus, the patient's movement pattern in the bed can be used to assist the patient when navigating around the room. This can, e.g., be done by turning on the light in the bathroom, such that the patient can easily find his way without disturbing the other patients. By using the actuator's means for registering changes in the force, a continuous reading and thus supervision of the patient's movement pattern is achieved. As these means constitute an integral part of the actuators, the price for this part of the actuator may be kept to a minimum. The connection of the actuator system to other light sources may be achieved with a cable connection and may thus be implemented without large expenses, as it would be a matter of one or more cables.

In a special embodiment the actuator system may be connected to the other light sources through a wireless connection. This would lower the cost of the solution and further increase the flexibility as the bed is not bound by a cable connection.

The invention further relates to a hospital or care bed comprising an electric actuator system of the type described above.

BRIEF DESCRIPTION OF THE DRAWINGS

An embodiment of the actuator system according to the invention will be described more fully below with reference to the accompanying drawings, in which.

DETAILED DESCRIPTION OF THE DRAWINGS

Figure 1:
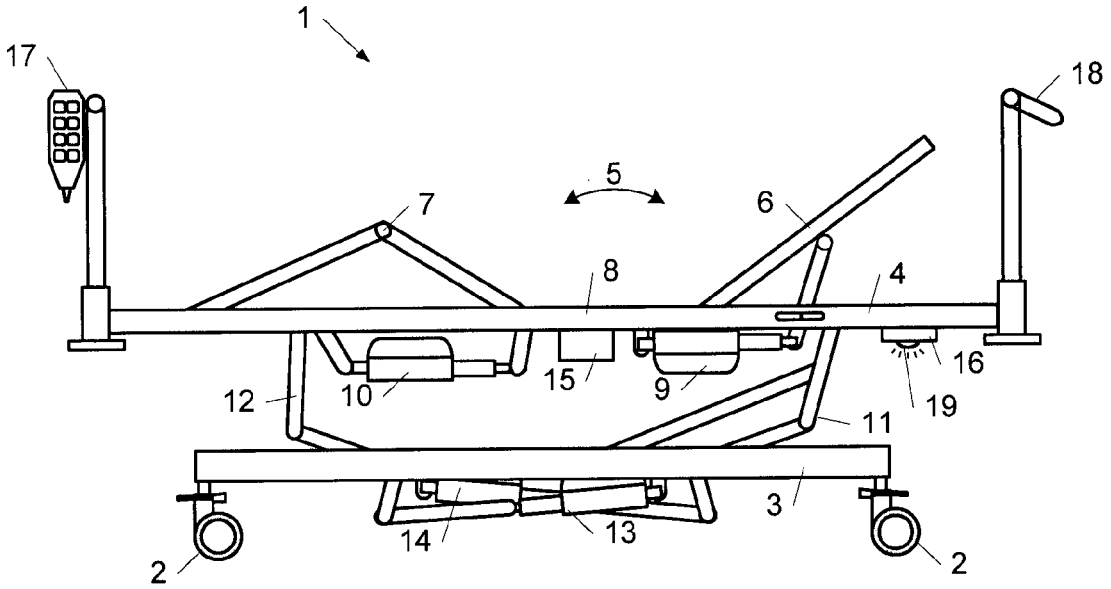
FIG. 1 shows a schematic view of a hospital or care bed comprising an actuator system in a first embodiment.

FIG. 1 shows a hospital bed 1 comprising an under frame 3 equipped with drive wheels 2 and an upper frame 4. An adjustable support surface 5 for a mattress (not shown) is mounted to the upper frame 4. The supporting surface comprises a backrest section 6, an articulated legrest section 7 and a fixed middle section 8 there between. The backrest and legrest sections 6,7 can be adjusted with an actuator 9, 10 each such that the supporting surface may assume different contours. The upper frame 4 is connected to the under frame 2 with a linkage 11,12 at each end. The upper frame 4 may be raised and lowered by means of a pair of actuators 13,14 connected to the linkages 11,12. All the actuators 9,10,13,14 are connected to a control box 15 comprising a control. The control box can be connected to mains and may e.g. be equipped with a power supply. The control box may further comprise a rechargeable battery pack.

A junction box 16 is connected to the control box 15 for connecting one or more control units, such as a hand control 17 and a control panel 18 integrated in the head or foot board, and possibly other peripheral equipment. The overall system comprising actuators 9,10,13,14, control box 15 and control units 17,18 is known as an actuator system.

One or more of the actuators 9,10,13,14 comprise means for registering the forces which the actuator (s) is exposed to as a result of the weight of the person lying in the bed, and the position and position changes of the person in the bed. This type of actuator is disclosed in WO 2009/021513 A1 Linak A/S and comprises the same elements as the linear actuator described in the preamble. Furthermore, this type of actuator comprises a load cell (not shown), e.g., in the form of a strain gauge or a piezoelement. Changes in the force on the actuator 9,10,13,14 are registered by the load cell and the information concerning these changes is sent to the control box 15. A linear actuator of this type is further described in connection with FIGS. 5 and 6.

As orientation light under the bed the junction box 16 can be equipped with a light source 19 of the type disclosed in EP 1 955 612 A2 Linak A/S.

Figure 2:
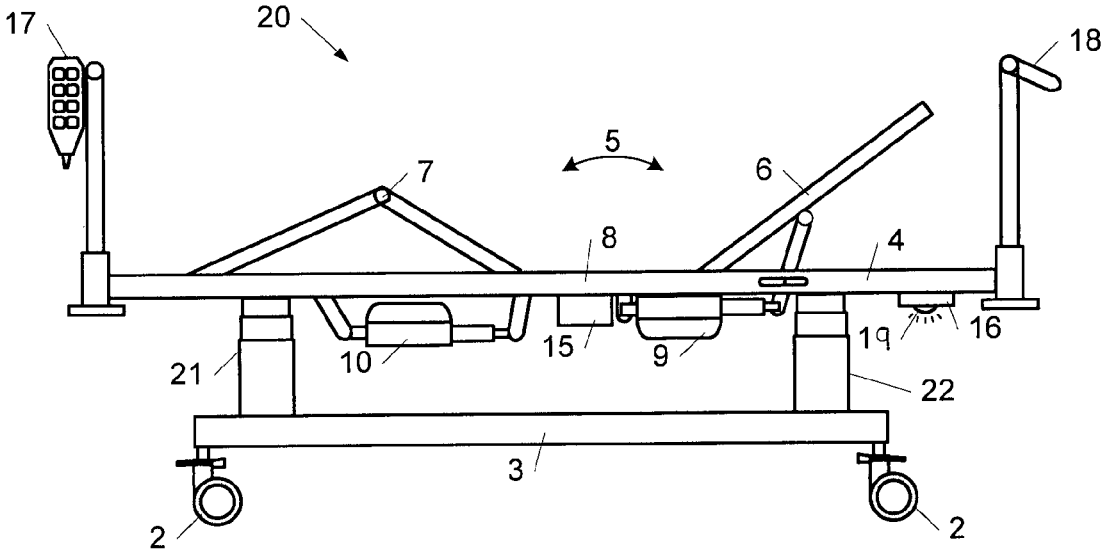
FIG. 2 shows a schematic view of a hospital or care bed comprising an actuator system in a second embodiment.

FIG. 2 shows a schematic view of the hospital and care bed 20 in another embodiment than the bed shown in FIG. 1. Here, the under frame 3 and upper frame 4 are not connected by linkages, but are instead connected by two linear actuators designed as lifting columns 21,22. These lifting columns 21,22 may also each contain a load cell for registering the force on the lifting column 21,22.

Figure 3:
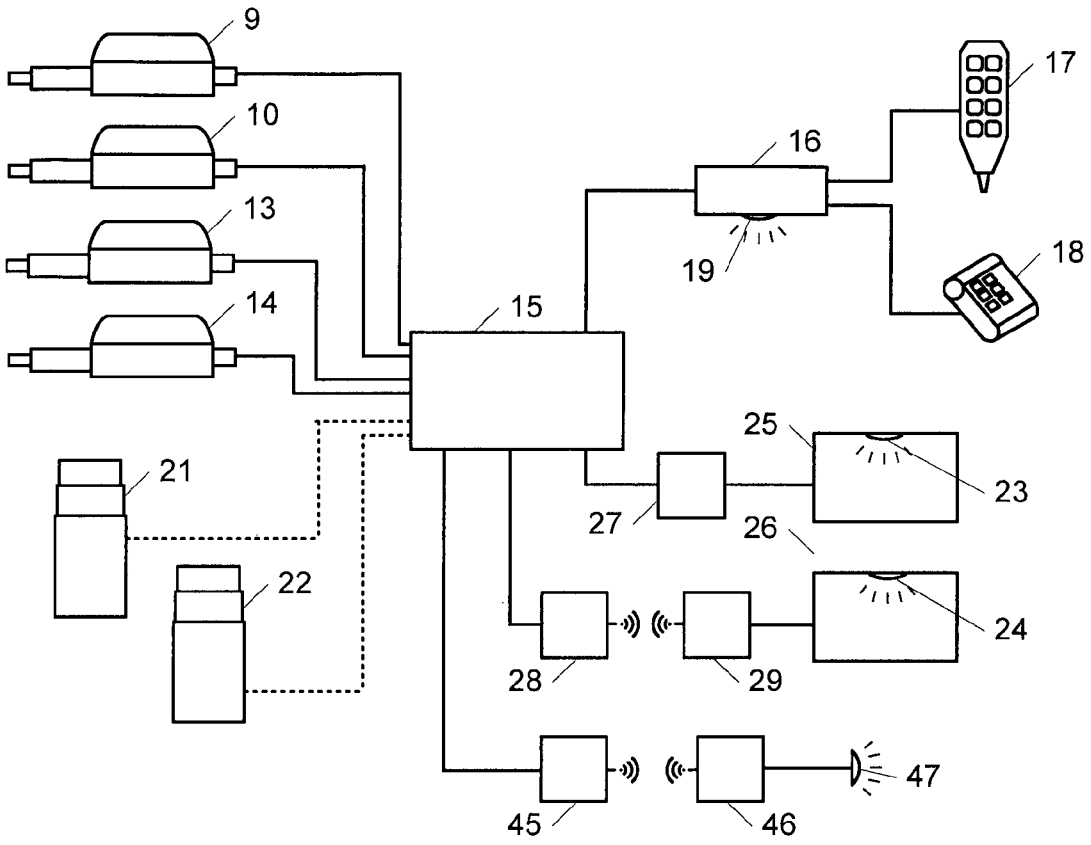
FIG. 3 shows a block diagram of an actuator system comprising other light sources.

As shown in FIG. 3 the control box 15 is further connected to other light sources 23,24 in, e.g., a bathroom 25 and a ward 26 in which the bed is located. When the patient sits up in bed, and thus potentially could be on his way out of bed or has already left the bed, these changes are registered in one or more of the actuators 9,10,13,14,21,22. The information concerning these changes is transmitted to the control box 15, which hereby can turn on one or more of the light sources 23,24 and/or the light source 19 under the bed. Thus, if the patient needs to go to the toilet during the night, the control box 15 may be programmed to turn on the light source 19 under the bed and the light 23 in the bathroom 25. Thus, the patient can find his way to the bathroom 25 without turning on the light 24 in the ward 26, thereby disturbing the other patients as little as possible.

The connection between the actuator system and the light sources may be cable connected and/or wireless. In FIG. 3 the connection between the control box 15 and the light 23 in the ward 25 is cable connected. When the light 23 should be turned on or off, the control box 15 transmits an on signal or off signal, respectively, to a relay 27. Hereby, the relay 27 will be drawn or released, at which the light 23 can be turned on and off. The connection between the control box 15 and the light 24 in the bathroom 26 is on the contrary wireless. In order to turn on the light 24 in the bathroom 26 the control box 15 generates a signal, which through a transceiver 28 is sent to the paging system or alarm system used in the given hospital or nursing home via a transceiver 29. Subsequently, the paging system or alarm system turns the light 24 on or off. The control box 15 can thus convert the information from the load cell in the linear actuator 9,10,13,14 into a signal, adapted to the communications protocol used by the paging system or alarm system. The transceiver 28 may e.g. be incorporated in the control box 15 or in the junction box 16. In a simpler embodiment a wireless transmitter 45 is connected to the control box 15. Here the wireless transmitter 45 sends to a wireless receiver 46 located directly in connection with the light source 47. In this embodiment it is thus not necessary for the on/off signals to be transmitted to the paging system or alarm system mentioned above. Thus, a very simple but highly functional actuator system may be provided at a very low cost. It is understood that the three different types of connections between the actuator system and the light sources shown in FIG. 3 can function as alternative to each other or in interaction with each other.

As shown in FIG. 3 the actuator system may also comprise lifting columns 21,22, as shown in FIG. 2. For the sake of clarity the connection between the lifting columns 21,22 and the control box 15 is shown as dotted lines.

Figure 4:
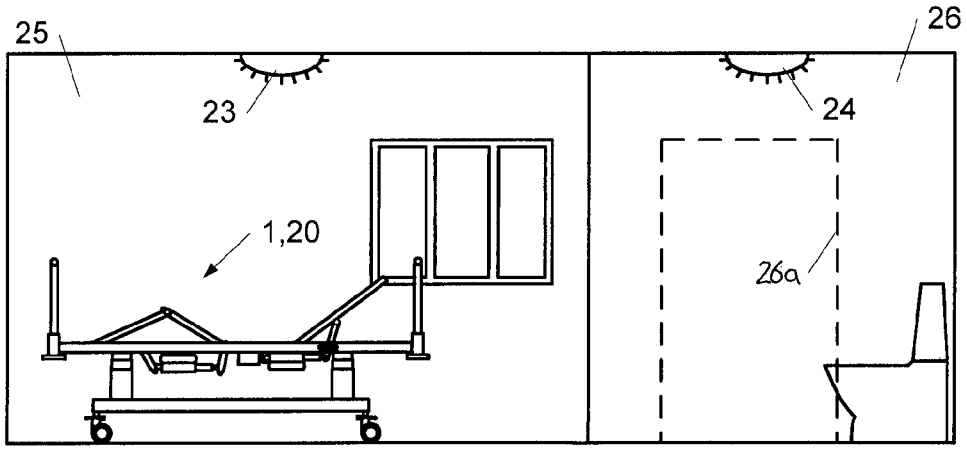
FIG. 4 shows a schematic view of a ward.

FIG. 4 shows a schematic view of a patient ward, comprising a ward 25 and a bathroom 26. From the ward 25 there is access to the bathroom 26 through the door 26*a*. The ward 25 contains a hospital or care bed 1,20 of the type described above. The actuator system in the bed 1,20 is connected to the light sources 23, 24 in the ward 25 and the bathroom 26, respectively. The actuator system and the connected light sources 23,24 function as described under FIGS. 1,2 and 3. Thus, the connected light sources 23,24 constitute a part of the actuator system.

Figures 5, 6:
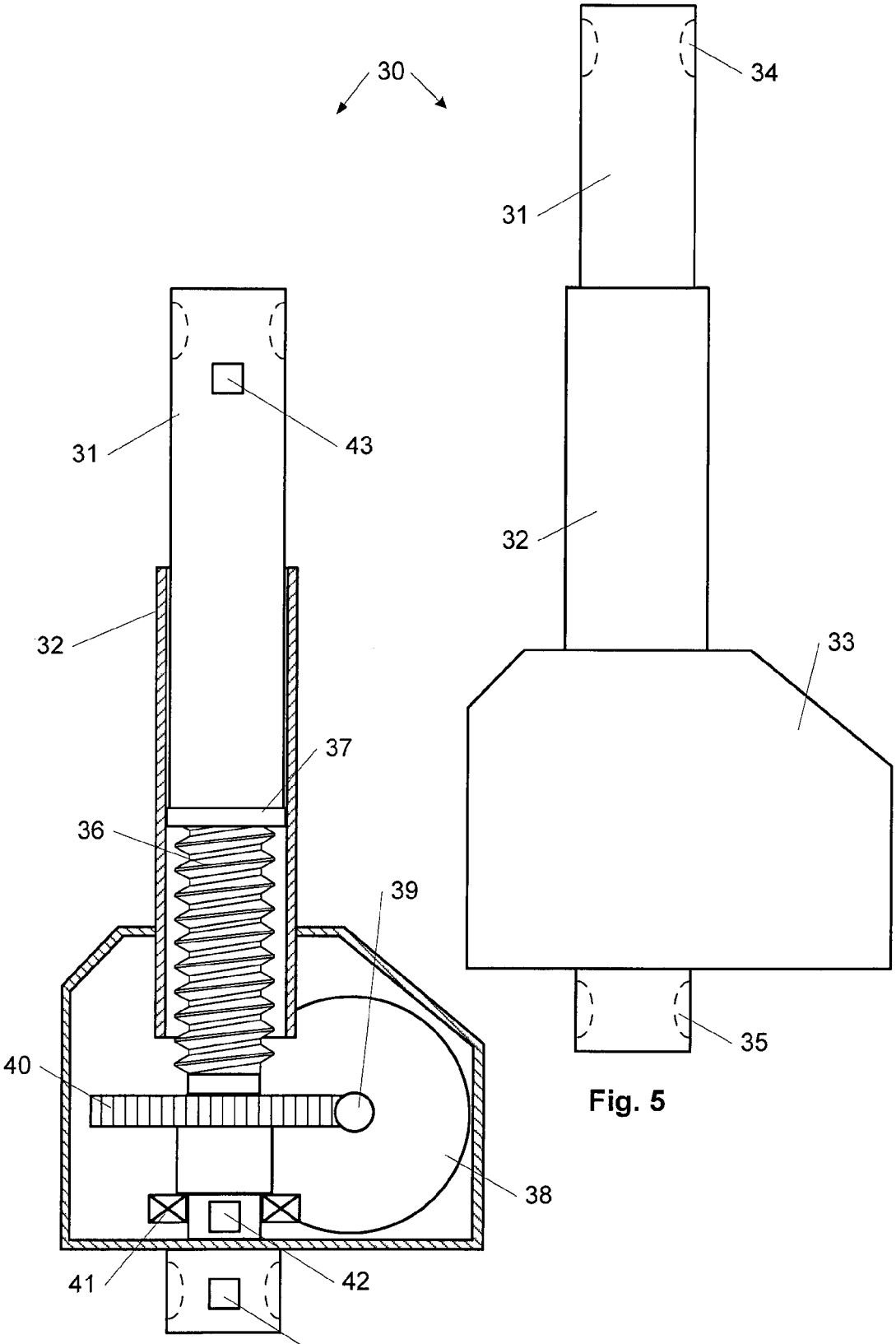
FIG. 5 shows a linear actuator.
FIG. 6 shows the linear actuator in FIG. 5 where the motor housing and the outer tube has been partially removed.

FIG. 5 shows a linear actuator 30 of the type described in the preamble comprising a thrust rod and is thus of the same type as the linear actuators 9,10,13,14. The thrust rod is also known as an inner tube 31. The linear actuator comprises an outer tube 32 and a motor housing 33. The linear actuator 30 further comprises a front mounting 34 at the outer end of the inner tube 31 and a rear mounting 35 at the motor housing 33.

FIG. 6 shows the linear actuator in FIG. 5, where the motor housing 33 and the outer tube 32 have been partially removed. The main components of the linear 30 are a spindle 36, on which a spindle nut 37 is arranged. The spindle nut 37 may be secured against rotation. The inner tube 31 is secured to the spindle nut 37 and may thus be moved inwards or outwards on the outer tube depending on the direction of rotation of the spindle 36. The spindle 36 is driven by a reversible electric motor 38 through a transmission. The transmission here comprises a worm 39 located in extension of the drive shaft 39 of the electric motor, and a worm wheel 40 secured to the spindle 36. Moreover, a bearing 41 is secured to the spindle 36. The bearing 41 may e.g. be a ball bearing or a roller bearing. The linear actuator 30 comprises a load cell 42 for registering the force, which the linear actuator 30 is exposed to and the relative changes to this force. In FIG. 6 the load cell 42 is located in connection with the rear part of the spindle 36. The load cell may also be arranged in connection with the inner tube or the rear mounting as indicated with reference numerals 43 and 44. The load cell 42,43,44 may e.g. be a strain gauge or a piezo element. The linear actuator 30 is connected to a control box 15 of the type described in connection with FIGS. 1-4. The information concerning the force on the linear actuator 30 or a change will thus be transmitted to the control box 15. The linear actuator 30 is, as stated above, disclosed in WO 2009/021513 A1 Linak A/S.

The linear actuator 30 shown hi FIGS. 5 and 6 only discloses the main components. Thus, the linear actuator 30 may be equipped with, e.g., a brake mechanism, additional bearings, release mechanism, etc.

It is noted that the invention further may be used in connection with so-called dual actuators comprising two spindle units and a control box in one common housing. This type is further described in WO 2007/093181 A1 Linak A/S.

The invention claimed is:

1. An electric actuator system for a hospital or care bed comprising, a plurality of linear actuators configured as lifting columns located on opposite sides of the bed between an upper frame and a lower frame of said bed, the lifting columns being configured to raise and lower the upper frame, a control box and at least one control unit, wherein the linear actuators and the at least one control unit are connected to the control box and wherein the linear actuators each comprises a load cell configured to register a force on the respective linear actuator and relative changes therein, and wherein the control box is configured to turn on at least one light source in response to the relative changes in the force upon the load cells of the linear actuators to assist movement of a user on the bed when the relative changes are indicative of a user attempting to leave the bed.

2. The electric actuator system according to claim 1, including means for wireless connection between said control box and said at least one light source.

3. The electric actuator system according to claim 1, wherein the control box comprises a mains based power supply.

4. The electric actuator system according to claim 1, wherein the control box comprises a rechargeable battery pack.

5. The electric actuator system according to claim 1, including a junction box.

6. The electric actuator system according to claim 1, wherein the at least one light source is located under the bed and is configured to illuminate a flooring surface on which the bed is positioned.

7. The electric actuator system according to claim 1, wherein the at least one light source is remote from the bed and is located in a bathroom and is configured to illuminate said bathroom.

* * * * *